US007427208B2

(12) United States Patent
Yang et al.

(10) Patent No.: US 7,427,208 B2
(45) Date of Patent: Sep. 23, 2008

(54) ELECTRICAL CONNECTOR

(75) Inventors: Xiang-Qi Yang, Kunshan (CN); Xiao-Gao Yang, Kunshan (CN); Chien-Hsun Huang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/786,226

(22) Filed: Apr. 11, 2007

(65) Prior Publication Data

US 2007/0243744 A1 Oct. 18, 2007

(30) Foreign Application Priority Data

Apr. 13, 2006 (CN) ..... 2006 2 0072593

(51) Int. Cl.
*H01R 13/62* (2006.01)

(52) U.S. Cl. ..... 439/326; 439/541.5

(58) Field of Classification Search ..... 439/326, 439/541.5, 630–637
See application file for complete search history.

(56) References Cited

U.S. PATENT DOCUMENTS 4,756,694 A * 7/1988 Billman et al. ..... 439/61
5,176,523 A * 1/1993 Lai ..... 439/64
6,176,737 B1 * 1/2001 Choy ..... 439/541.5
7,021,953 B2 4/2006 Kawamae
2001/0010984 A1 * 8/2001 Bricaud et al. ..... 439/630
2005/0048828 A1 3/2005 Ho et al.

FOREIGN PATENT DOCUMENTS

TW 595814 6/2004

* cited by examiner

*Primary Examiner*—Ross N Gushi
(74) *Attorney, Agent, or Firm*—Wei Te Chung

(57) ABSTRACT

An electrical connector (1, 2) includes a base (11, 21) having an upper wall (13, 23), a lower wall (14, 24), a pair of connecting walls (136, 236) connecting the upper and lower wall together, and a slot (12, 22) opening frontwardly for receiving a card (4, 5) between the upper wall and the lower wall, the lower wall protruding to the forefront of the connector and forming a pair of supporting portions (19, 29) before the connecting walls, a plurality of terminals (17, 18, 27, 28) retained in the base (11, 21), and a housing portion (130, 131, 230, 231) defined on the upper wall of the base (11, 21), the housing position (130, 131, 230, 231) receiving a protrusion of other connector stacked on the electrical connector (1, 2).

12 Claims, 6 Drawing Sheets

ELECTRICAL CONNECTOR

BACKGROUND

1. Field of the Invention

The invention relates to an electrical connector, particularly to an electrical connector connecting a card to a printed circuit board.

2. The Related Art

US patent application publication number 20050048828 A1 discloses a card edge connector assembly which makes it possible to install card or cards side by side at a high density on a motherboard. The card edge connector assembly comprises a circuit board, a connector, an electronic card and a fixing structure. The fixing structure has an elastic element having a fixing portion positioned on the circuit board. Two relating opposing sides of the fixing portion extends two elastic arms whose free ends form a beveled edge and a clasp portion, and define positioning slots on the rear rim of the electrical card. The connector has a base, a pair of positioning posts extruding downwardly from the base, and a plurality of terminals with tails retained in the base. The connector is located on the circuit board via the pair of positioning posts inserting into a pair of positioning holes of the circuit printed, and the tails of the terminals are mounted on the circuit printed board by SMT (Surface Mounting Technology). Understandably, two or more connectors are limited to stack compactly with respect to each other because of the positioning posts which extrude outwardly from the base of the connector. Thus, it may cause difficulty in transportation of these connectors. On the other hand, the connector has two rows of terminals with L-shaped mounting portion which are mounted on the top surface of the circuit printed board, thus, the connection between the connector and the circuit printed board is weak.

Therefore, it is desired to have an improved electrical connector assembly to overcome the disadvantages of the prior art.

SUMMARY OF THE INVENTION

Accordingly, an object of the present invention is to provide an electrical connector manufactured easy and connecting stably with a printed circuit board.

To achieve the above-mentioned object, the invention is to provide an electrical connector comprising a base having an upper wall, a lower wall, a pair of connecting walls connecting the upper and lower wall together, and a slot opening frontwardly for receiving a card between the upper wall and the lower wall, the lower wall protruding to the forefront of the connector and forming a pair of supporting portions before the connecting walls, a plurality of terminals retained in the base, and a housing portion defined on the upper wall of the base.

Other objects, advantages and novel features of the present invention will become more apparent from the following detailed description of the present embodiment when taken in conjunction with the accompanying drawings.

DETAILED DESCRIPTION OF THE PREFERRED EMBODIMENT

Figure 1:
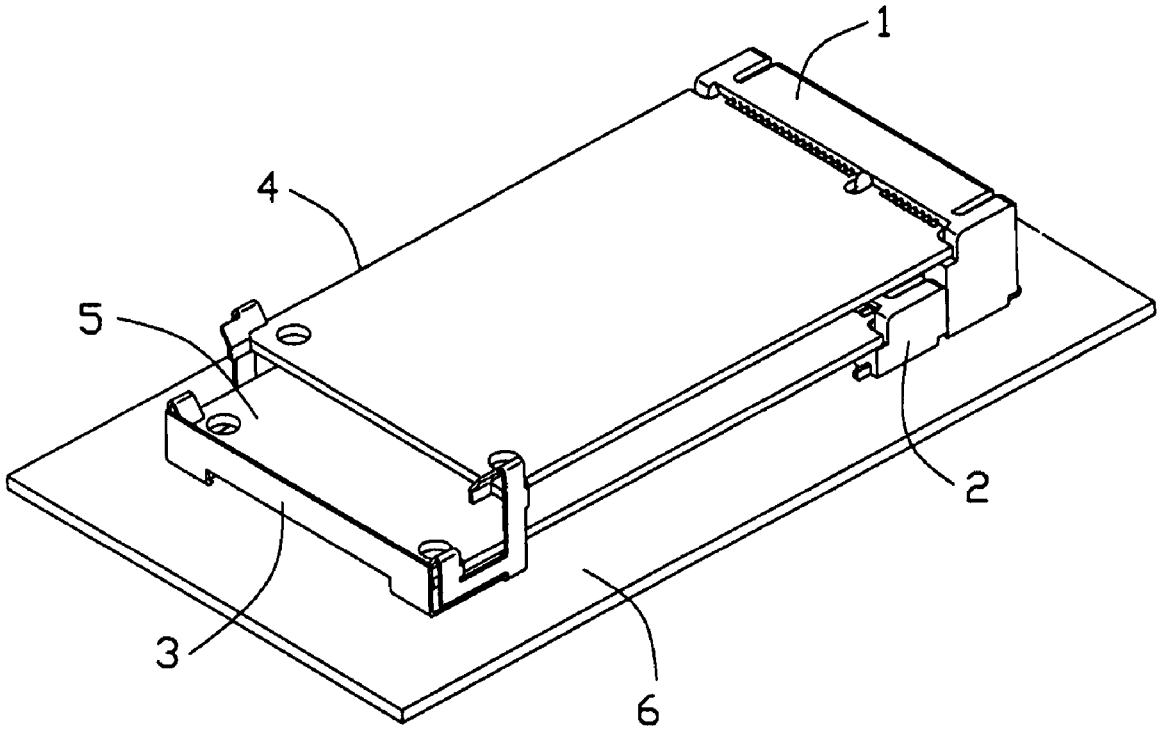
FIG. 1 is an assembled, perspective view of an electrical connector assembly in accordance with a preferred embodiment of the present invention.

References will now be made to the drawing figures to describe the preferred embodiment of the present invention in detail.

It will be noted here that for a better understanding, most of like components are designated by like reference numerals throughout the various figures in the embodiments. Referring to FIG. 1, an electrical connector assembly comprises a first electrical connector 1, a second electrical connector 2 and a latch 3. The first connector 1, the second connector 2 cooperates with the latch 3 for connecting mechanically and electrically electronic cards 4,5 to a PCB (printed circuit board) 6. In this state, a front-to-rear direction is defined from the latch to the first and second connectors 1, 2.

Figure 5:
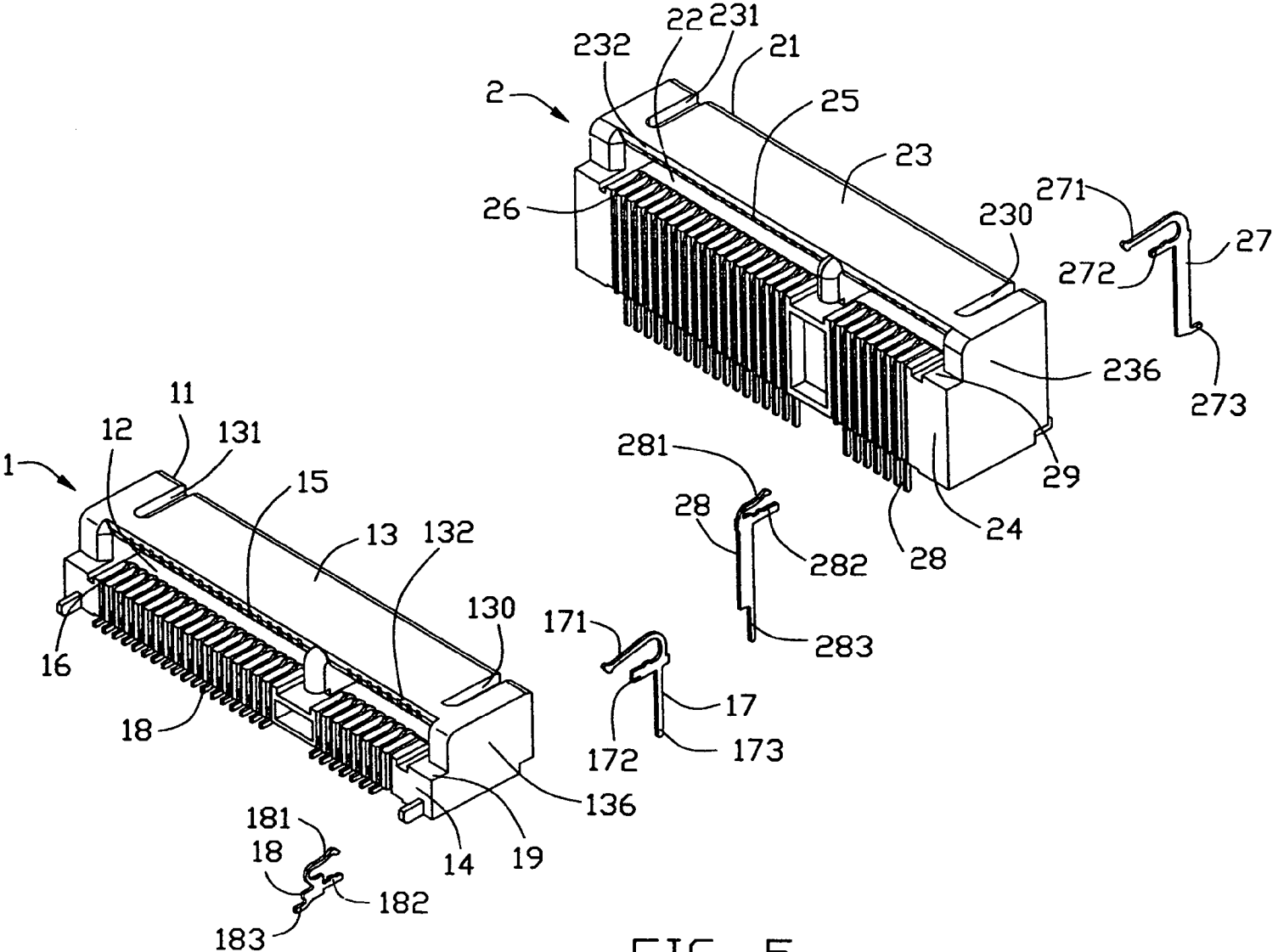
FIG. 5 is a perspective view of the second connector assembly.

Referring to FIG. 5, the first connector 1 has a elongated first base 11 and a row of first upper terminals 17 and a row of first lower terminals 18 retained therein. The first base 11 includes a first upper wall 13, a first lower wall 14, a pair of connecting walls 136 connecting the upper and lower wall together, and a first slot 12 opening frontwardly defined between the first upper wall 13 and the first lower wall 14. The lower wall 14 protruding to the forefront of the connector 1 and forming a pair of supporting portions 19 before the connecting walls 136, the supporting portions 19 support the card 5 thereon. The first upper wall 13 defines a lot of first upper grooves 15 along the first slot 12, which communicate with the slot 12. Likely, the first lower wall 14 defines a lot of first lower grooves 16 communicating with the slot 12. The first upper terminal 17 attached to the first base 11 from rear side of the first base 11 includes a retaining portion 172 retaining the first upper terminal 17 to the base 11, a mating portion 171 which extends upwardly through the first upper groove 15 and into said first slot 12, and a mounting portion 173 which is pin-shaped and extends downwardly for mounted to the PCB 6. The first lower terminal 18 attached to the first base 11 from front side of the first base 11 includes a retaining portion 182 retaining the first lower terminal 18 to the base 11, a mating portion 181 which extends upwardly through the first lower groove 16 and into said first slot 12, and a mounting portion 183 which is L-shaped and extends downwardly for mounted to the PCB 6.

Referring to FIG. 5, the second connector 2 has a elongated second base 21 and a row of second upper terminals 27 and a row of second lower terminals 28 retained therein. The elongated second base 21 includes a second upper wall 23, a second lower wall 24, a pair of connecting walls 236 connecting the upper and lower wall together, and a second slot 22 opening frontwardly defined between the second upper wall 23 and the second lower wall 24. The lower wall 24 protruding to the forefront of the connector 2 and forming a pair of supporting portions 29 before the connecting walls 236, the supporting portions 29 support the card 4 thereon. The second upper wall 23 defines a lot of second upper grooves 25 along the second slot 22, which communicate with the second slot 22. Likely, the second lower wall 24 defines a lot of second lower grooves 26 communicating with the second slot 22. The second upper terminal 27 attached to the second base 21 from rear side of the second base 21 includes a retaining portion 272 retaining the second upper terminal 27 to the second base 21, a mating portion 271 which extends upwardly through the second upper groove 25 and into said second slot 22, and a mounting portion 273 which is L-shaped and extends downwardly for mounting to the PCB 6. The second lower terminal 28 attached to the second base 21 from front side of the second base 21 includes a retaining portion 282 retaining the second lower terminal 28 to the second base 21, a mating portion 281 which extends upwardly through the second lower groove 26 and into said second slot 22, and a mounting portion 283 which is pin-shaped and extends downwardly for mounting to the PCB 6.

Figure 2:
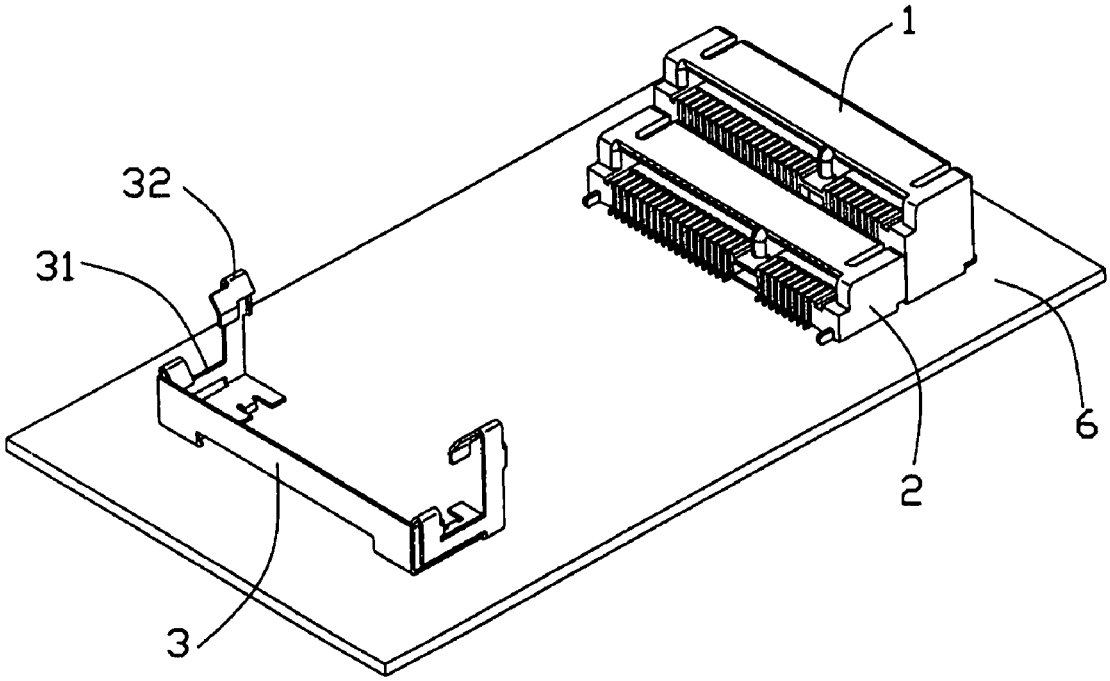
FIG. 2 an exploded, perspective view of the electrical connector assembly shown in FIG. 1, wherein two cards are detached therefrom.
Figure 4:
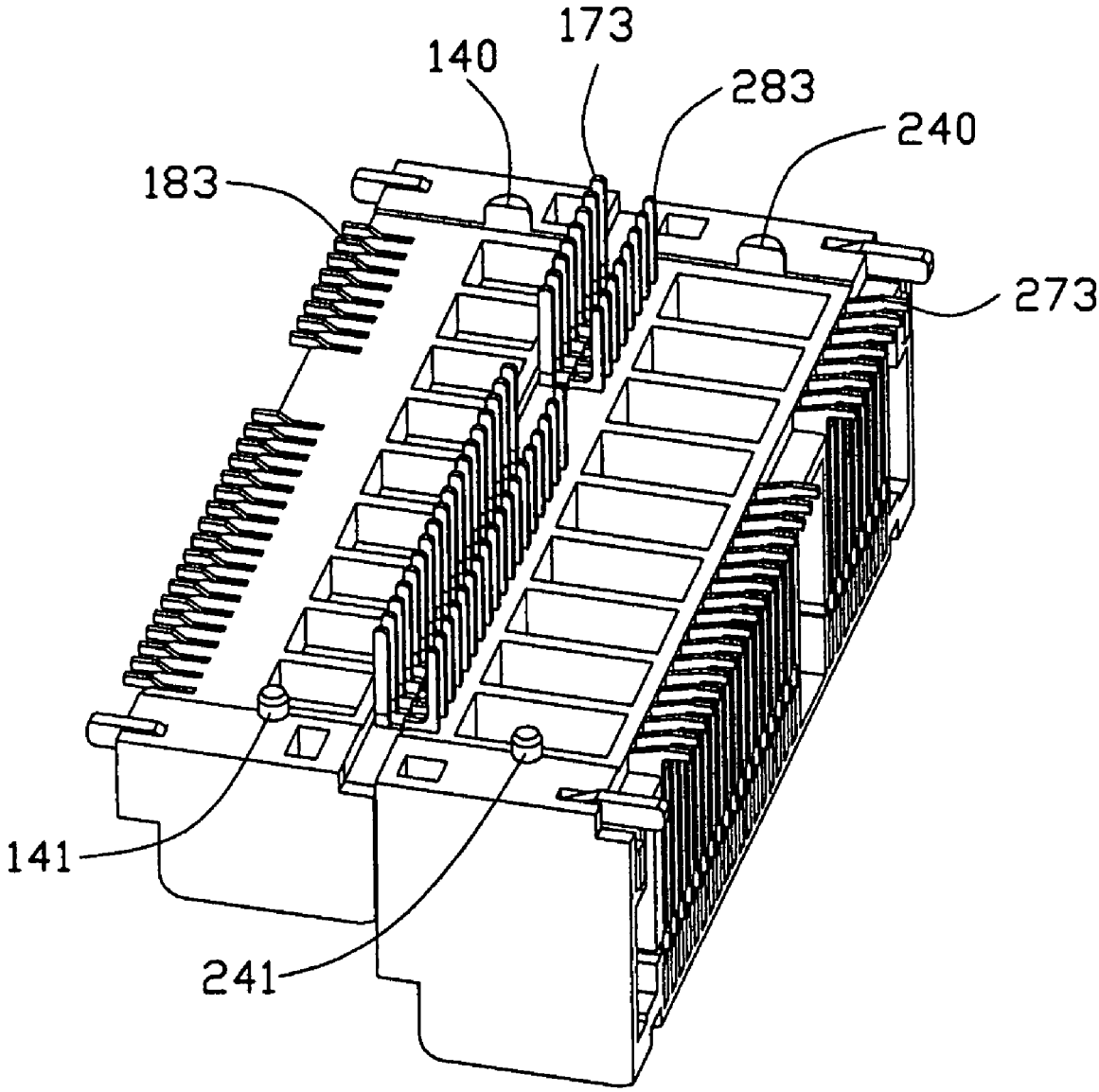
FIG. 4 is an exploded, perspective view of the first connector assembly of FIG. 3.
Figure 6:
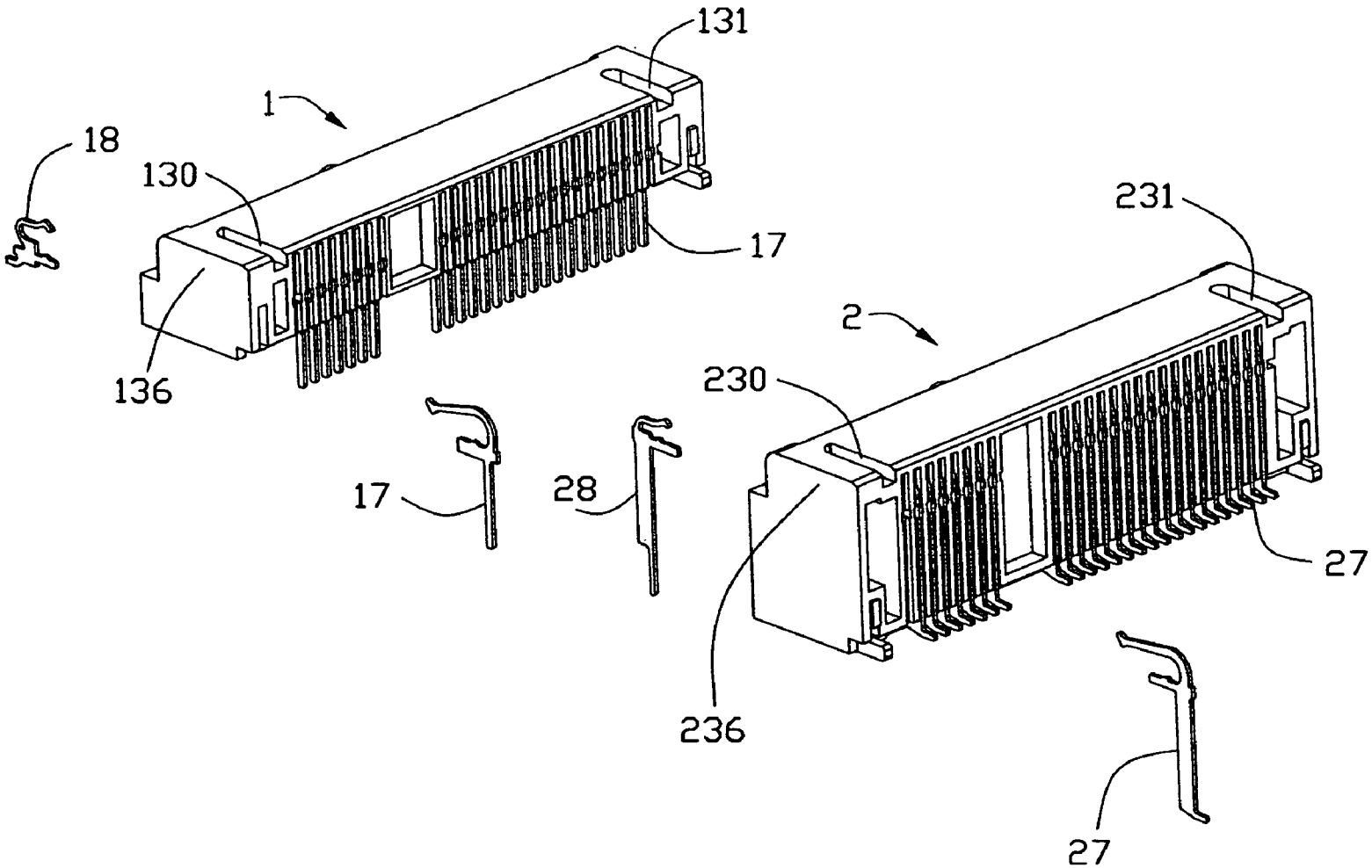
FIG. 6 is an exploded, perspective view of the second connector assembly of FIG. 5.

Referring to FIGS. 2, 4, 6, the first connector 1 has a pair of positioning posts 140, 141 extending downwardly from the first lower wall 14 and a pair of housing portions 130, 131, which are defined on the first upper wall 13. In factory, the first base 11 and the first upper and lower terminals 17, 18 are produced separately. Then, a plurality of first bases 11 are sent to assemble with the first upper and lower terminals 17, 18, during transport, the first bases 11 stack compactly each other via the positioning posts 140, 141 are received in the housing portions 130, 131. It is noted that the positioning posts 140, 141 and the housing portions 130, 131 are corresponding so that the positioning posts 140, 141 are received in the housing portions 130, 131 stably. In current embodiment, the housing portions 130, 131 are cutouts which open upwardly and rearwardly, and not frontwardly, that is, the front rim 132 of the first upper wall 13 is continuous which results in the first upper wall 13 connecting to the first base 11 fast. On the other hand, the positioning posts 140, 141 of each first connector 1 are different in dimension and shape, correspondingly, the housing portions 130, 131 of each first connector 1 are also different in dimension and shape for matching above-mentioned positioning posts 140, 141, thus, the connectors stack each other with the slots opening at the same direction. The positioning posts 140, 141 coupling the housing portions 130, 131 serves as a guider so that a first base 11 stacks on another first base 11 from the rear side of another first base 11.

Likely, the second connector 2 has a pair of positioning posts 240, 241 extending downwardly from the second lower wall 24 and a pair of housing portions 230, 231, which are defined on the second upper wall 23. The housing portion 230, 231 are cutouts which open upwardly and rearwardly, and not frontwardly, the front rim 232 of the second upper wall 23 is continuous. The positioning posts 240, 241 and housing portions 230, 231 of each second connector 2 are different in dimension and shape. Understandably, the first connectors 1 or second connectors 2 may stack each other if the mounting portions of terminals are L-shaped via the housing portions receiving the positioning posts. In order to reduce the stack height of the connectors 1, 2 with other type connector, the housing portions 130, 131, 230, 231 also receive some protrusions of other type connector.

Figure 3:
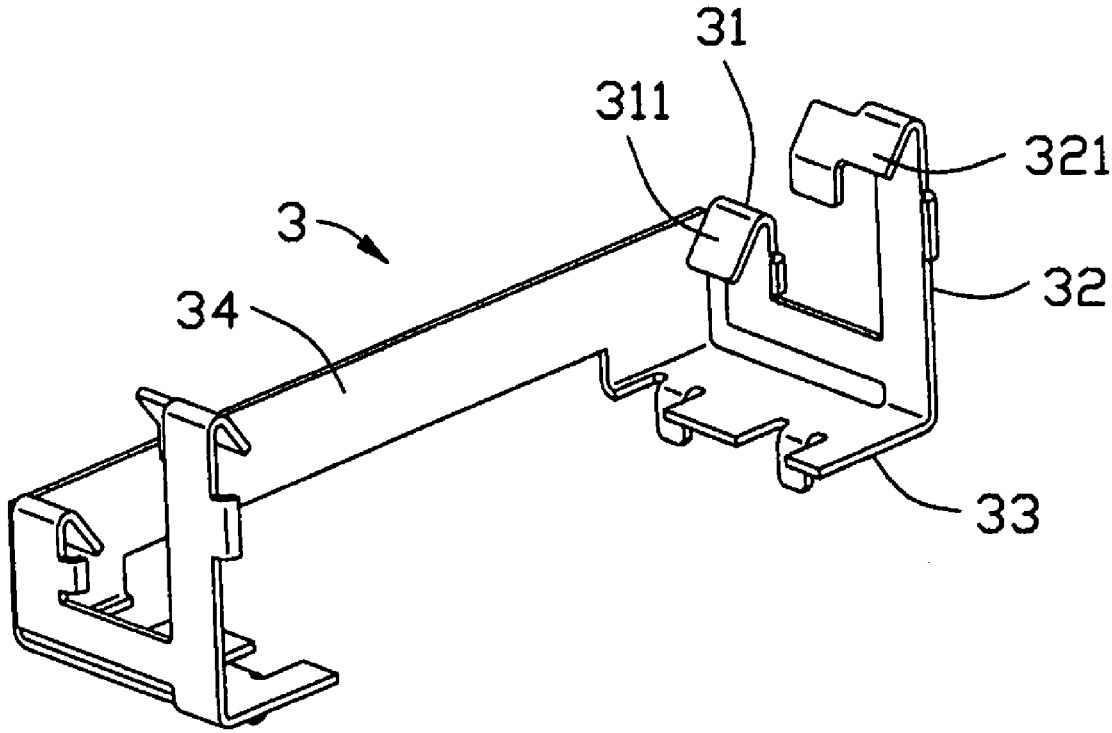
FIG. 3 is a perspective view of the first connector assembly.

Referring to FIGS. 1-3, the latch 3 has a pair of mounting portions 33, a pair of latching portions 31, 32, and a connecting portion 34 connecting the pair of mounting portions 33. Each latching portion 31 has a latching member 311, and each latching portion 32 has a latching member 321, wherein the latching member 321 is located above the latching member 311 on the PCB 6.

Referring to FIGS. 2, 4, the first connector 1 and the second connector 2 are used together and cooperate with the latch 3 to retain a pair of cards 4, 5. The second connector 2 is positioned via the posts 240, 241 inserting into corresponding holes (not shown) of the PCB 6 and mounted on the PCB 6 with the first slot 12 opening frontwardly and the mounting portions 173, 183 mounted to the PCB 6. The first connector 1 is located before the second connector and positioned via the posts 140, 141 inserting into corresponding holes (not shown) of the PCB 6 and mounted on the PCB 6 with the second slot 22 opening frontwardly and the mounting portions 273, 283 mounted to the PCB 6. The latch 3 is located at front side with regard to the first and second connectors.

In assembling, the mounting portions 173 are inserted into corresponding holes of the PCB 6 and mounted to the PCB 6, while the mounting portions 183 are mounted on the top surface of the PCB 6. There are a stable connection between the first connector 1 and the PCB 6 because the mounting portion 173 are inserted into corresponding holes and mounted to the PCB 6. On the other hand, the PCB 6 keeps solid because the first connector 1 has only a row of mounting portion 173 and the PCB 6 has only a row of holes. Likely, the second connector 2 has the same mounting portions 273, 283 for connecting stably to the PCB 6. It is more important for keeping the PCB solid that only part mounting portions is pin-shaped when there are three or more connectors, at the same time, the connectors and the PCB 6 connect stably. In current embodiment, the mounting portions 173 of the first connector 1 and the mounting portions 283 of the second connector 2 are close so that the connectors can approach each other, thus, the connectors occupy a lesser space above the PCB 6. In some other conditions, the connectors are located on the PCB being close each other in front-to-rear direction, the mounting portions being L-shaped of the first connector and the second connector are close, or the mounting portions being pin-shaped and being L-shaped of two or more connectors are altemant.

During assembling, the rear rim of the card 5 is inserted into the slot 12, the front rim of the card 5 pass the latching member 311, and then the latching member 311 latch the card 5 in a state in which the card is substantially parallel to the PCB 6. Likely, the rear rim of the card 4 is inserted into the slot 22, the front rim of the card 4 pass the latching member 321, and then the latching member 321 latch the card 4 in a state in which the card is substantially parallel to the PCB 6. After assembly, the card 4 is located above the card 5 on the PCB 6.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of ordinary skill in this field are to understand that all such equivalent structures are to be included within the scope of the following claims.

We claim:

1. An electrical connector comprising:

a base;

a plurality of terminals retained in the base; and a housing portion defined on the base, the housing portion being a cutout opening upwardly and rearwardly;

wherein said base has an upper wall and a lower wall, and a slot opening frontward for receiving a card between the upper wall and the lower wall, the housing portion is defined on the upper wall, a positioning post protrudes downwardly from the lower wall;

wherein another positioning post protrudes downwardly from the lower wall, and corresponding another housing portion is defined on the upper wall of the base and opens upwardly and rearward;

wherein said positioning posts are different in dimension and shape, said housing portions are different in dimension and shape, and the positioning posts and housing portions match in shape and dimension.

2. The electrical connector as described in claim 1, wherein the front rim of the upper wall is continuous.

3. The electrical connector as described in claim 1, wherein said two housing portions and two the positioning posts are corresponding so that the housing portions of the electrical connector adapt for receiving the positioning posts of another same electrical connector so that the base without the terminals stacks compactly on another same base without the terminals.

4. An electrical connector comprising:

a base comprising an upper wall, a lower wall and a rear wall to define a slot opening frontward;

a first row of terminal receiving grooves arranged side-by-side, each extending forwards to communicate with the slot and extending downwards along the rear wall;

a second row of terminal receiving grooves arranged side-by-side and each extending rearwards to communicate with the slot;

a plurality of terminals received in said grooves;

a pair of cutout portions located on the upper wall;

a pair of positioning posts extending downwards from a bottom of the lower wall, and aligning with and matching corresponding positioning posts.

5. The electrical connector as described in claim 4, wherein the second row of the grooves extends downward along a front face of the lower wall.

6. The electrical connector as described in claim 4, wherein the terminals received in the first row of said grooves each comprises a mating portion extending into the slot and a mounting portion located in the rear wall.

7. The electrical connector as described in claim 4, wherein the lower wall projects forward to the upper wall and ten forming a pair of supporting portions adjacent to two opposite ends of the base.

8. The electrical connector as described in claim 4, wherein the cutout portions open upwards and rearwards, not forwards.

9. The electrical connector as described in claim 8, wherein said cutout portions are different in dimension and shape.

10. An electrical connector assembly comprising:

plural electrical connectors arranged by abutting with each other along a front and back direction;

each connector comprising:

a base having a slot opening forwards, and a front wall and a rear wall opposite to the front wall;

a plurality of terminals each comprising a mating portion extending into the slot and a mounting portion extending along the front wall or the rear wall;

wherein the mounting portions of the terminals on the walls against which the plural electrical connectors abutting, are of pin shape, while the mounting portion of the terminals on the another walls opposite to said wall are of L shape so as to the plural electrical connectors are arranged compactly.

11. The electrical connector assembly as described in claim 10, wherein the slots of the electrical connectors locates on different levels.

12. The electrical connector assembly as described in claim 11, wherein the connector with a high level slot defines its L-shaped mounting portion in the front wall thereof.

* * * * *